US008374852B2

(12) United States Patent
Murashima

(10) Patent No.: US 8,374,852 B2
(45) Date of Patent: Feb. 12, 2013

(54) APPARATUS AND METHOD OF CODE CONVERSION AND RECORDING MEDIUM THAT RECORDS PROGRAM FOR COMPUTER TO EXECUTE THE METHOD

(75) Inventor: Atsushi Murashima, Tokyo (JP)

(73) Assignee: NEC Corporation, Tokyo (JP)

( * ) Notice: Subject to any disclaimer, the term of this patent is extended or adjusted under 35 U.S.C. 154(b) by 1322 days.

(21) Appl. No.: 11/376,436

(22) Filed: Mar. 16, 2006

(65) Prior Publication Data

US 2006/0222084 A1 Oct. 5, 2006

(30) Foreign Application Priority Data

Mar. 29, 2005 (JP) ..... 2005-095735

(51) Int. Cl.

| | |
|---|---|
| ***G10L 11/06*** | (2006.01) |
| ***G10L 19/12*** | (2006.01) |
| ***G10L 11/00*** | (2006.01) |
| ***G10L 19/00*** | (2006.01) |
| ***G10L 21/04*** | (2006.01) |

(52) U.S. Cl. ..... 704/210; 704/215; 704/221; 704/200; 704/219; 704/222; 704/223; 704/214; 704/270; 704/500; 704/501; 704/502; 704/503; 704/504

(58) Field of Classification Search ..... 704/200, 704/219, 221, 222, 223, 210, 215, 214, 500, 704/229, 270, E19.049, 501, 502, 503, 504; 370/466–467

See application file for complete search history.

(56) References Cited

U.S. PATENT DOCUMENTS 5,835,889 A * 11/1998 Kapanen ..... 704/215
5,991,716 A * 11/1999 Lehtimaki ..... 704/212
6,424,822 B1 * 7/2002 Mekuria et al. ..... 455/72
6,654,718 B1 * 11/2003 Maeda et al. ..... 704/229
6,678,654 B2 * 1/2004 Zinser et al. ..... 704/221
6,766,291 B2 * 7/2004 Chu et al. ..... 704/215
6,832,195 B2 * 12/2004 Johnson ..... 704/270
7,023,880 B2 * 4/2006 El-Maleh et al. ..... 370/466

(Continued)

FOREIGN PATENT DOCUMENTS

EP 1 288 813 A2 3/2003
EP 1 288 913 A2 3/2003

(Continued)

OTHER PUBLICATIONS

H. Purnhagen. An overview of MPEG-4 Audio Version 2. In AES 17th International Conference on High Quality Audio Coding, Florence, Italy, Sep. 1999.*

(Continued)

*Primary Examiner* — Edgar Guerra-Erazo
(74) *Attorney, Agent, or Firm* — Foley & Lardner LLP

(57) ABSTRACT

Disclosed is a code conversion method to convert a first code sequence conforming to a first speech coding scheme into a second code sequence conforming to a second speech coding scheme. The method includes the following steps. The first step discriminates whether the first code sequence corresponds to a speech part or to a non-speech part, and generates a numerical value that indicates the discrimination result as a control flag. The second step converts the first code sequence into the second code sequence and outputs said second code sequence, when the value of the control flag corresponds to the speech part. The third step outputs the second code sequence that corresponds to the value of the control flag, when the value of the control flag corresponds to the non-speech part.

20 Claims, 7 Drawing Sheets

U.S. PATENT DOCUMENTS

| | | | | |
|---|---|---|---|---|
| 7,092,875 | B2 | 8/2006 | Tsuchinaga et al. | |
| 7,310,322 | B2 * | 12/2007 | Graf et al. | 370/328 |
| 7,505,590 | B1 * | 3/2009 | Apostolopoulos | 380/210 |
| 7,630,884 | B2 * | 12/2009 | Murashima | 704/219 |
| 2002/0006138 | A1 * | 1/2002 | Odenwalder | 370/468 |
| 2002/0016161 | A1 * | 2/2002 | Dellien et al. | 455/403 |
| 2002/0118650 | A1 * | 8/2002 | Jagadeesan et al. | 370/260 |
| 2003/0065508 | A1 * | 4/2003 | Tsuchinaga et al. | 704/215 |
| 2003/0083102 | A1 * | 5/2003 | Blum et al. | 455/560 |
| 2005/0027517 | A1 * | 2/2005 | Jabri et al. | 704/219 |
| 2005/0053130 | A1 * | 3/2005 | Jabri et al. | 375/240 |
| 2005/0084094 | A1 * | 4/2005 | Gass et al. | 379/416 |
| 2005/0258983 | A1 * | 11/2005 | Jabri et al. | 341/50 |
| 2005/0265399 | A1 * | 12/2005 | El-Maleh et al. | 370/537 |
| 2010/0223053 | A1 * | 9/2010 | Sandgren et al. | 704/219 |

FOREIGN PATENT DOCUMENTS

| | | | |
|---|---|---|---|
| EP | 1 395 065 | A1 | 3/2004 |
| EP | 1 617 415 | A1 | 1/2006 |
| JP | 63-231500 | A | 9/1988 |
| JP | 8-330972 | A | 12/1996 |
| JP | 2001-265390 | A | 9/2001 |
| JP | 2001-316753 | | 11/2001 |
| JP | 2003-76394 | A | 3/2003 |
| WO | WO 2004/095424 | A1 | 11/2004 |

OTHER PUBLICATIONS

Bessette, B.; Salami, R.; Lefebvre, R.; Jelinek, M.; Rotola-Pukkila, J.; Vainio, J.; Mikkola, H.; Jarvinen, K.;, "The adaptive multirate wideband speech codec (AMR-WB)," Speech and Audio Processing, IEEE Transactions on, vol. 10, No. 8, pp. 620-636, Nov. 2002.*

H. Kang et al., "Improving Transcoding Capability of Speech Coders in Clean and Frame Erasured Channel Environments," Proc. of IEEE Workshop on Speech Coding, 2000, pp. 78-80.

M. Schroeder et al., "Code-excited Linear Prediction (CELP): High-quality Speech at Very Low Bit Rates," Proc. of IEEE Int. Conf. on Acoustics, Speech and Signal Processing, 1985, pp. 937-940.

3GPP TS 26.101 V3.3.0, 3rd Generation Partnership Project; Technical specification Group and System Aspects; AMR Speech Codec Frame Structure, 1999, pp. 1-19.

3G TS 26.090 V3.1.0, 3rd Generation Partnership Project, Mandatory Speech Codec speech processing functions AMR speech codec; Transcoding Functions, 1999, pp. 1-61.

3G TS 26.094 V3.0.0, 3rd Generation Partnership, Mandatory Speech Codec speech processing functions AMR speech codec; Voice Activity Detector (VAD), 1999, pp. 1-29.

International Telecommunication Union-T, "Pulse code modulation (PCM) of voice frequencies," pp. 1-10, 1993.

* cited by examiner

| TYPE OF PAYLOAD | SIZE OF PAYLOAD | FRAME TYPE |
|---|---|---|
| SPEECH | 244 bits | 7 |
| NON-SPEECH (NOISE) | 39 bits | 8 |
| NON-SPEECH (SILENCE) | 0 bits | 15 |

FIG.3

APPARATUS AND METHOD OF CODE CONVERSION AND RECORDING MEDIUM THAT RECORDS PROGRAM FOR COMPUTER TO EXECUTE THE METHOD

RELATED APPLICATIONS

This application is based upon and claims the benefit of priority from Japanese patent application No. 2005-095735, filed on Mar. 29, 2005, the disclosure of which is incorporated in its entirety herein by reference.

BACKGROUND OF THE INVENTION

1. Field of the Invention

The present invention relates to encoding and decoding technology for transmitting or storing speech signals at low bit rates. In particular, the present invention relates to code conversion (transcoding) technology for converting a first code sequence obtained by encoding a speech signal with a first speech coding scheme into a second code sequence that is decodable with another speech coding scheme.

2. Description of the Related Art

Code Excited Linear Prediction (CELP) is well known as one of the speech coding schemes that encode a speech signal efficiently at medium and low bit rates. The CELP scheme is described in:

[1] M. R. Schroeder and B. S. Atal, "Code excited linear prediction: high quality speech at very low bit rates," *Proc. of IEEE Int. Conf. on Acoustics, Speech and Signal Processing*, pp. 937-940, 1985.

According to the CELP scheme, the encoder separates, from the input speech signal, Linear Prediction (LP) coefficients for characterizing a linear prediction filter and an excitation signal for exciting this LP filter. The encoder encodes the LP coefficients and the excitation signal, and transmits them to the decoder. The decoder sets the received LP coefficients to its LP filter and excites this LP filter with the received excitation signal to reproduce a high quality speech signal.

This excitation signal is expressed by a weighted sum of Adaptive Codebook (ACB) and Fixed Codebook (FCB). The ACB contains pitch periods of the input speech signal, whereas the FCB consists of random numbers and pulses. Multiplying the ACB and FCB components by their respective gains (ACB gain and FCB gain) yields the excitation signal.

When a 3G (third generation) mobile-network and a wired packet network, for example, are to be interconnected, standard speech coding schemes used in these networks may be different. Thus, in order to achieve direct connection of these two networks, code conversion technology between different speech coding schemes (i.e. transcoding) would be required. Tandem connection is known as one of the transcoding technologies for speech coding.

FIG. 1 shows code conversion apparatus based on the conventional tandem connection. This code conversion apparatus converts a first code sequence produced with a first speech coding scheme into a second code sequence to be decoded with a second speech coding scheme.

With reference to FIG. 1, the conventional code conversion apparatus is described hereafter. The code sequence is input and output at a frame period (e.g. 20 msec) which is a processing unit of speech coding and decoding. As will be described later, each frame consists of a header and a payload.

In FIG. 1, a code sequence conversion circuit 1100 consists of a speech decoding circuit 1050 and a speech encoding circuit 1060. The speech decoding circuit 1050 decodes a first code sequence supplied to an input terminal 10 with a first speech coding scheme. A speech encoding circuit 1060 encodes (or re-encodes) the decoded speech signal being output from the speech decoding circuit 1050 with a second speech coding scheme to generate a second code sequence.

Regarding the speech encoding and decoding scheme, details are found in the reference [1] above and in

[2] 3GPP TS 26.090, "AMR Speech Codec; Transcoding Functions."

However, the code conversion apparatus in FIG. 1 requires a large amount of processing to achieve the code conversion. The reason for this is that in this code conversion apparatus the speech decoding circuit decodes the first code sequence and re-encodes the decoded speech signal.

US2003/0065508A(reference [3]) discloses a code conversion apparatus which converts the first input code sequence into the code sequence of the second speech coding scheme without decoding a non-speech part within the first code sequence.

In this code conversion apparatus, a code separation part separates a non-speech code within the first code sequence into a plural number of element codes, and a non-speech code conversion part converts these element codes into a plural number of element codes for the second speech coding scheme. This code conversion apparatus multiplexes the second element codes obtained by this conversion to output the second non-speech code sequence. The code conversion apparatus further multiplexes this second non-speech code sequence and a second speech code sequence being converted by a speech code conversion part, and outputs the second code sequence.

This code conversion apparatus requires a non-speech code conversion circuit which converts a first non-speech code sequence into a second non-speech code sequence. This non-speech code conversion requires a large amount of processing. For example, consider a case where the non-speech code sequence conforming to the AMR scheme is to be converted into the non-speech code sequence conforming to ITU-T Recommendation G.729. Each of the code sequences contains LP coefficient information indicating spectrum envelope and power information for every frame as comfortable noise (CN) information.

However, the encoder for the AMR scheme transmits at every 8 frames average values over 8 frames of the LP coefficients and power information. On the other hand, the encoder for the G.729 transmits average values over the previous 6 frames or values for the present frame of the LP coefficient information non-periodically. The encoder for the G.729 also transmits average values over the previous 3 frames or values for the present frame of the power information.

Namely, between these two speech coding schemes, not only concrete codes for the CN information but also transmission intervals for each element code are different. Therefore, the non-speech code conversion circuit given in the reference [3] requires a large amount of processing for converting the element codes.

SUMMARY OF THE INVENTION

The first exemplary feature of the invention provides code conversion apparatus with a reduced amount of processing for the code conversion stated above.

According to a first exemplary aspect of the invention, there is provided a code conversion method to convert a first code sequence conforming to a first speech coding scheme into a second code sequence conforming to a second speech coding scheme. The method includes the following steps. The first step discriminates whether the first code sequence corresponds to a speech part or to a non-speech part, and generates a numerical value that indicates the discrimination result as a control flag. The second step converts the first code sequence into the second code sequence and outputs said second code sequence, when the value of the control flag corresponds to the speech part. The third step outputs the second code sequence that corresponds to the value of the control flag, when the value of the control flag corresponds to the non-speech part.

The first exemplary aspect of the invention reduces the amount of processing regarding the non-speech code, when the first code sequence conforming to the first speech coding scheme is converted into the second code sequence conforming to the second speech coding scheme. The reason for this is that the first exemplary aspect of the invention discriminates, based on the information obtained from the first code sequence, whether the code sequence corresponds to a speech part or to a non-speech part. A numerical value indicating this discrimination result is generated as a control flag. And the first exemplary aspect of the invention generates the non-speech part of the second code sequence, based on the value of this control flag. Conversion of the non-speech part code sequence according to the first exemplary aspect of the invention does not require the process consisting of decoding with the first speech coding scheme and re-encoding with the second speech coding scheme.

The first exemplary aspect of the invention significantly reduces the amount of processing in comparison with the conversion process where the non-speech part code sequence as represented by the reference [2] is converted into the non-speech part code sequence for other speech coding schemes. The reason for this is that the first exemplary aspect of the invention does not convert the first non-speech code sequence into the non-speech code sequence for the second speech coding scheme but generates the code sequence corresponding to the non-speech part for the second speech coding scheme (or outputs a pre-stored code sequence) based on the information indicating the type of the code sequence obtained from the first code sequence. Therefore, the amount of computation required for the code conversion can be significantly reduced.

Other features and aspects of the invention will become apparent from the descriptions of the preferred embodiments.

BRIEF DESCRIPTION OF THE DRAWINGS

The above and further objects, novel features and advantages of the present invention will be more fully understood from the following detailed description when read together with the accompanying drawings in which:

FIG. 3 shows a relationship between the type of payload, the size of payload and the type of frame according to the AMR speech coding scheme;

DETAILED DESCRIPTION OF THE PREFERRED EMBODIMENTS

Figure 1:
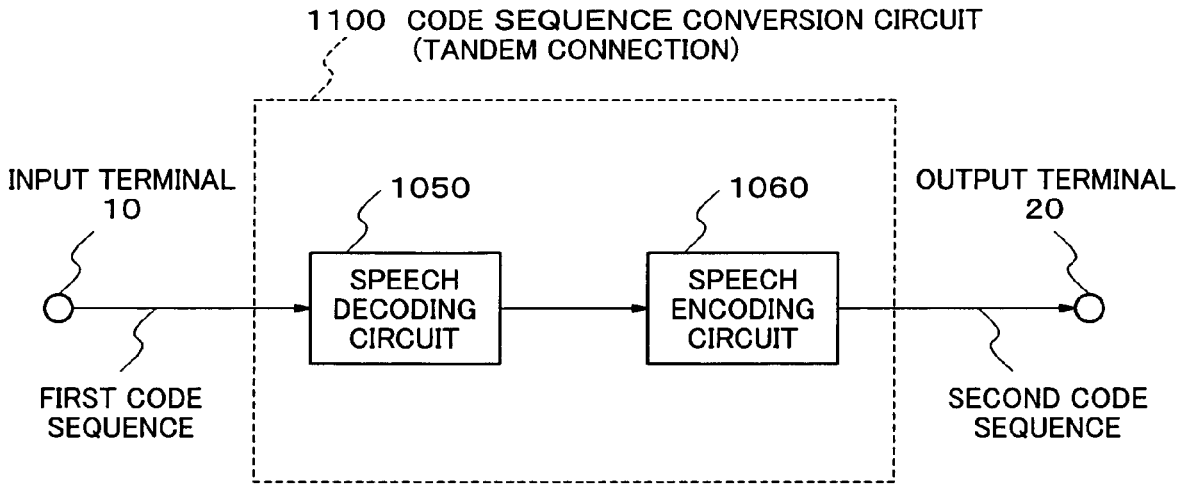
FIG. 1 is a block diagram showing code conversion apparatus of the related art.

First, outlines and principles of the present invention are explained.

In the description below, "non-speech" means sounds other than voice and music. "Non-speech" includes silence, noise, tones, etc.

The method of the present invention has the following basic steps.

[STEP A] This step discriminates, using information contained in each frame of the first code sequence, whether the first code sequence within the frame corresponds to speech or non-speech part, and generates a control flag indicating the discrimination result.

[STEP B] This step converts the first code sequence into the second code sequence, when the control flag indicates speech part.

[STEP C] This step generates the second code sequence corresponding to the value of the control flag, when the control flag indicates non-speech part. STEP C may read and output the pre-stored second code sequence that corresponds to type information of non-speech.

STEP A can be replaced by the following STEPs A1 and A2.

[STEP A1] This step decodes a speech signal from the first code sequence with the first decoding method.

[STEP A2] This step generates a control flag that indicates whether the said first code sequence corresponds to speech or non-speech part, using the decoded speech signal.

The present invention, based on the information obtained from the first code sequence, discriminates the type information that indicates to which of a speech part or a non-speech part the first code sequence corresponds. Further, the present invention discriminates the type information of the non-speech part. If the number of types of the non-speech part is only one, then the number of values of the control flag for this non-speech part is one. When the first code sequence corresponds to the non-speech part, the present invention generates, based on the value of this control flag, a non-speech code sequence for the second speech coding scheme without performing the process of code conversion (decoding with the first speech coding scheme and re-encoding the decoded signal with the second speech coding scheme).

Thus, the present invention reduces, in accordance with the ratio of the non-speech part to the whole code sequence, the amount of processing required for decoding the first code sequence with the speech decoding circuit for the first speech coding scheme and then re-encoding the speech signal obtained by the said decoding with the speech encoding circuit for the second speech coding scheme. In general, the time ratio for the non-speech part is larger than that for the speech part. Therefore, the effect of reduction in the required amount of processing realized by the present invention is remarkable, even if the speech part is decoded and re-encoded as in tandem connection.

Moreover, the present invention does not require the process that is essential to the technology in the reference [3], namely the process for separating the element codes, converting the separated element codes and multiplexing the converted element codes. For this reason, the present invention can shorten the time required for converting the non-speech code sequence.

Embodiment 1

Next, Embodiment 1 of the present invention will be explained in detail referring to FIG. 2, which is a block diagram showing the structure of Embodiment 1.

Figure 2:
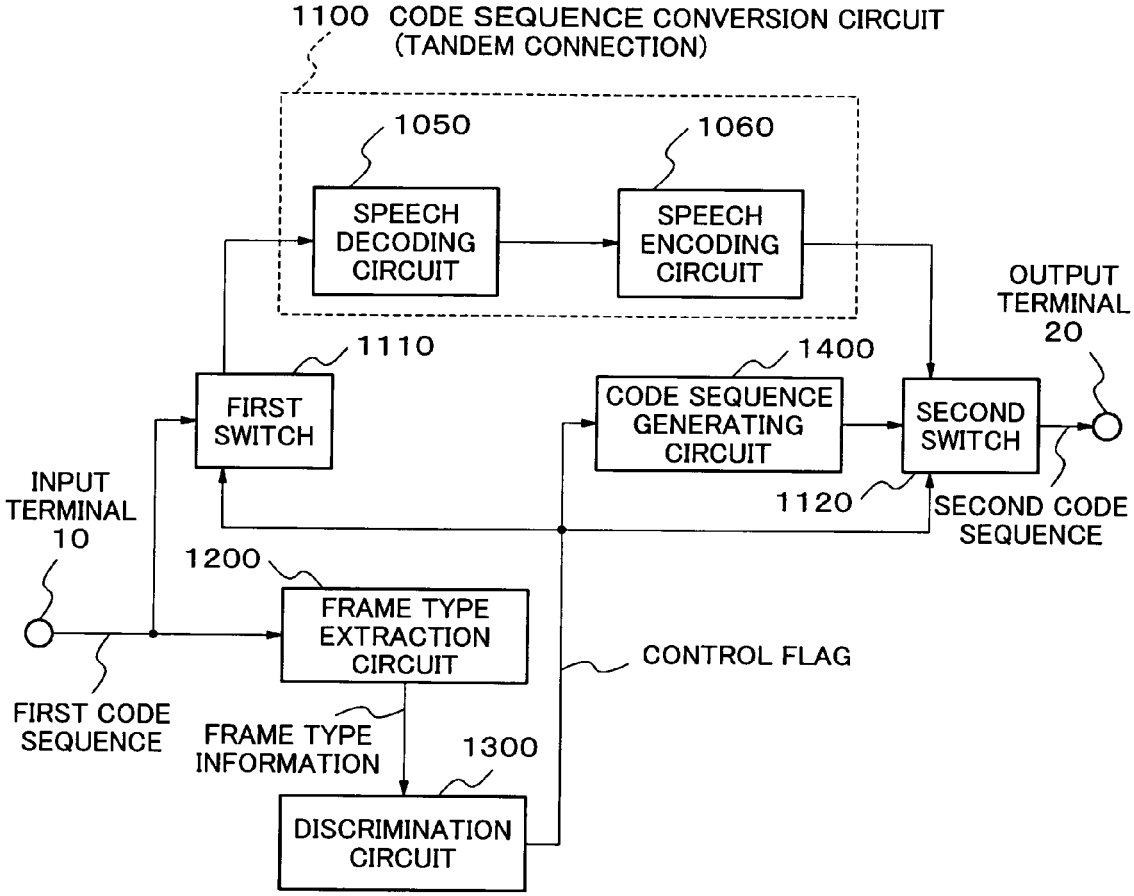
FIG. 2 is a block diagram showing the first embodiment of code conversion apparatus of the present invention.

In FIG. 2, identical or equivalent elements appearing in FIG. 1 for an example of the related art are denoted with the same reference numerals. In FIG. 2, an input terminal 10, an output terminal 20, a speech decoding circuit 1050 and a speech encoding circuit 1060 provide basically the same functions as those elements shown in FIG. 1 except that starting conditions are different from those in FIG. 1. The description of Embodiment 1 below omits explanation of the above mentioned identical or equivalent elements and focuses on the differences in the structure from those shown in FIG. 1. Namely, the description below explains Embodiment 1, focusing on a frame type extracting circuit 1200, a discrimination circuit 1300, a code sequence generating circuit 1400, a first switch 1110 and a second switch 1120.

The frame type extracting circuit 1200 separates a header and a payload from the first code sequence supplied to the input terminal 10. Then, the frame type extracting circuit 1200 extracts frame type information from this header, and outputs this frame type information to the discrimination circuit 1300.

The discrimination circuit 1300 receives the frame type information from the frame type extracting circuit 1200. The discrimination circuit 1300 generates a control flag based on this frame type information. The discrimination circuit 1300 outputs this control flag to the first switch 1110, the second switch 1120 and the code sequence generating circuit 1400. The discrimination circuit 1300 outputs a control flag with value "0," when the frame type information indicates a speech part. The discrimination circuit 1300 outputs a control flag with value "1," when the frame type information indicates noise. The discrimination circuit 1300 outputs a control flag with value "2," when the frame type information indicates silence. Namely, based on the frame type information, Embodiment 1 acquires the type information of the first code sequence within the frame.

In general, the first code sequence includes a header and a payload. Since the header contains the frame type information, the discrimination circuit can discriminate whether the decoded signal from the first code sequence within the frame corresponds to the speech part or to the non-speech part (silence or noise) without decoding the first code sequence.

The details of the header and the frame type information are described in

[4] 3GPP TS 26.101, "AMR Speech Codec Frame Structure."

The payload contains code sequences corresponding to parameters representing a speech signal (speech parameters), when the frame type information indicates speech. Here, the speech parameters include e.g. LP coefficients, ACB, FCB, ACB gain and FCB gain. On the other hand, the payload contains code sequences representing noise (noise parameters), when the frame type information indicates non-speech. The noise parameters include e.g. LP coefficients and frame energy.

The size of payload for non-speech is smaller than that for speech, or zero. Namely, the size of payload has different values for the speech part and the non-speech part.

Therefore, by discriminating the size of payload or the size of frame in the first code sequence instead of discriminating the frame type information, the discrimination circuit of Embodiment 1 may discriminate for each frame whether the decoded signal from the first code sequence corresponds to the speech part or to the non-speech part.

According to the reference [4] above, a relationship between the type of payload (speech, non-speech or silence), the size of payload and the frame type is as given in FIG. 3, when speech signals are encoded at the bit rate of 12.2 kbit/s.

In FIG. 2, the first switch 1110 receives the first code sequence from the input terminal 10 and the control flag from the discrimination circuit 1300. When the control flag is "0" (indicating speech), the first switch outputs the first code sequence to the speech decoding circuit 1050. When the control flag is either "1" (indicating noise) or "2" (indicating silence), the first switch does not output the first code sequence.

Here, Embodiment 1 can be modified so that when the control flag is "0" or "1" the first switch outputs the first code sequence to the speech decoding circuit 1050.

Though the code sequence conversion circuit 1100 of Embodiment 1 has a similar structure to that in FIG. 1, the code sequence conversion circuit 1100 in FIG. 2 decodes with the speech decoding circuit 1050 and re-encodes with the speech encoding circuit 1060 only the first code sequence supplied from the first switch.

The code sequence generating circuit 1400 generates the second code sequence corresponding to the first code sequence of the non-speech part, and outputs this second code sequence to the second switch 1120. Here, "to generate the second code sequence corresponding to the first code sequence of the non-speech part" means "to generate the second code sequence for noise, silence or tones corresponding to the value of the control flag."

Next, a case where the control flag indicates silence is explained. In generating the second non-speech code sequence, the code sequence generating circuit 1400 refers to the value of the control flag.

For example, if the second speech coding scheme conforms to 3GPP AMR Codec, the size of payload for silence is 0 bit as mentioned above. In this case, the second code sequence generated consists of the header (frame type is 15) only.

And, for example, if the second speech coding scheme conforms to ITU-T Recommendation G.711, the code indicating silence is 0×FF and the payload consists of the 0×FF codes whose number is equal to the number of the samples corresponding to the frame length. For instance, if the frame length is 20 msec and the sampling frequency is 8000 Hz, the number of the samples corresponding to the frame length is calculated to be 160. Therefore, the payload in this case is 1280 bit data having 160 0×FF codes.

The details of G.711 is given in

[5] ITU-T Recommendation G.711, "Pulse Code Modulation (PCM) of Voice Frequencies."

Whereas the above description concerns an example of generating the second code sequence for silence, it is possible in the present Embodiment to generate the second code sequence for noise. For example, the code sequence generating circuit 1400 internally stores pre-encoded noise conforming to the second speech coding scheme. Then, the code sequence generating circuit 1400 can generate this encoded noise in accordance with the value of the control flag.

Here, the code sequence generating circuit may be modified to output a second code sequence corresponding to a predetermined substitute signal (for example, a substitute signal determined by an upper apparatus of this embodiment) when the control flag value is a value other than "0(speech)". For instance, the code sequence generating circuit may be modified to output the second code sequence corresponding to "silence" even when the control flag value indicates non-speech part ("silence", "noise", "tone" etc. Further, the code sequence generating circuit may be modified to output the second code sequence corresponding to "noise" with small amplitude even when the control flag value indicates non-speech part.

In FIG. 2, when the control flag supplied by the discrimination circuit 1300 is "0" (indicating speech), the second switch 1120 outputs the second code sequence being output from the speech encoding circuit 1060 to the output terminal 20. And, when said flag is either "1" (indicating noise) or "2" (indicating silence) or "3" (tone), the second switch 1120 outputs the second code sequence being output from the code sequence generating circuit 1400 to the output terminal 20.

Here, as was mentioned above, Embodiment 1 may be modified so that when the control flag is "0" or "1" the second switch 1120 outputs the second code sequence being output from the speech encoding circuit 1060 to the output terminal 20.

Since the embodiment does not necessitate any modifications of the speech decoding circuit and the speech encoding circuit, said speech decoding circuit or said speech encoding circuit conforming to respective standard coding schemes can be used as it is.

The present Embodiment brings about effects of reducing the amount of processing, when the input speech coding scheme (the first scheme) and the output speech coding scheme (the second scheme) are of the same kind or even of different kinds. For example, when the input speech coding scheme and the output speech coding scheme are of the same kind, this corresponds to altering the bit rate. Even in this case, Embodiment 1 reduces the amount of processing for the non-speech part.

Further, if the first coding scheme of the first code sequence is the same as the second coding scheme of the second code sequence, the embodiment may also be modified as next. In this case, this modification does not require the code conversion function of the speech part. Namely, in the modification, the code conversion 1100 of FIG. 2 is not necessary and the first switch 1110 and the second switch 1120 are connected directly.

Embodiment 2

Figure 4:
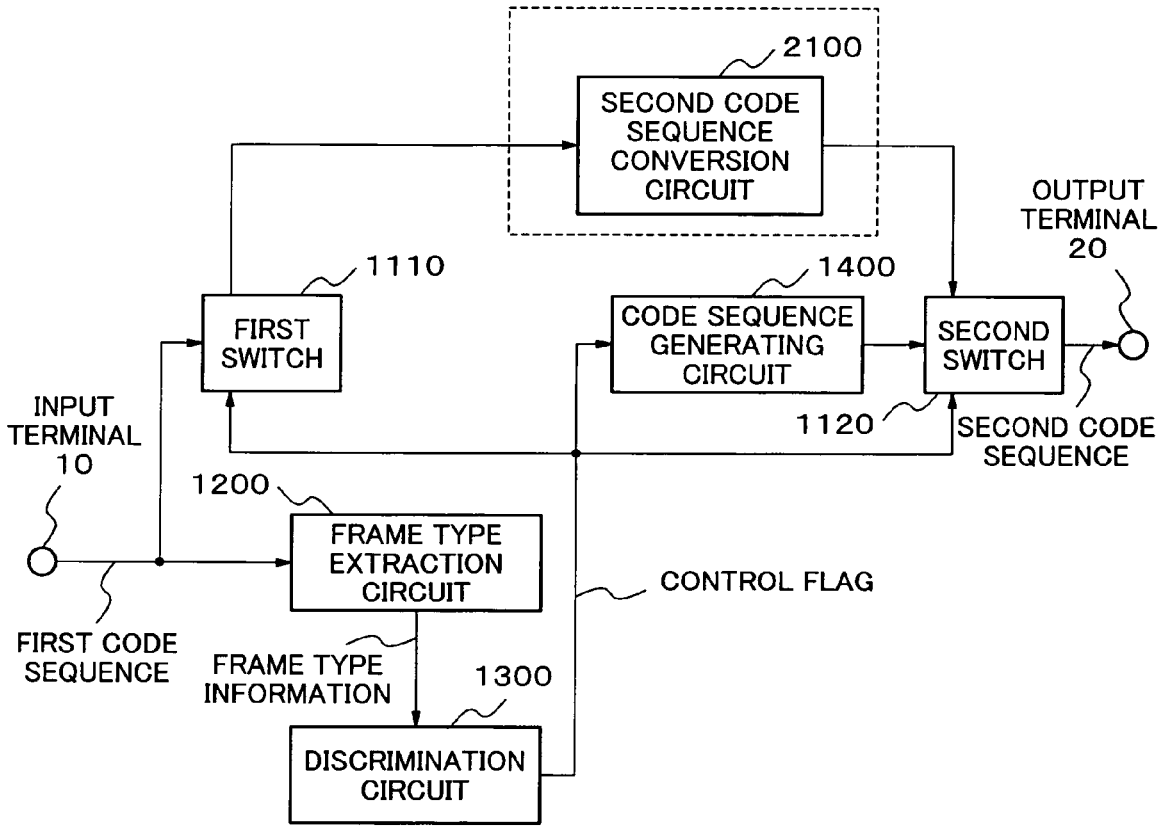
FIG. 4 is a block diagram showing the second embodiment of code conversion apparatus of the present invention.

FIG. 4 is a diagram showing the structure of Embodiment 2 of the code conversion apparatus according to the present invention. In FIG. 4, identical or equivalent elements appearing in FIG. 2 are denoted with the same reference numerals.

In the present Embodiment, the code sequence conversion circuit 1100 of tandem connection in Embodiment 1 is replaced by a second code sequence conversion circuit 2100. Thus, the second code sequence conversion circuit 2100 will be explained below.

The second code sequence conversion circuit 2100 performs code conversion for each code corresponding to the speech parameters of the first code sequence of the speech part being supplied from the first switch 1110. And the second code sequence conversion circuit 2100 outputs to the second switch 1120 a code sequence that consists of the codes converted by this code conversion. The details of the code conversion without the tandem connection are described in

[6] Hong-Goo Kang et al., "Improving transcoding capability of speech coders in clean and frame erasured channel environments," *Proc. of IEEE Workshop on Speech Coding* 2000, pp. 78-80, 2000.

Embodiment 3

Figure 5:
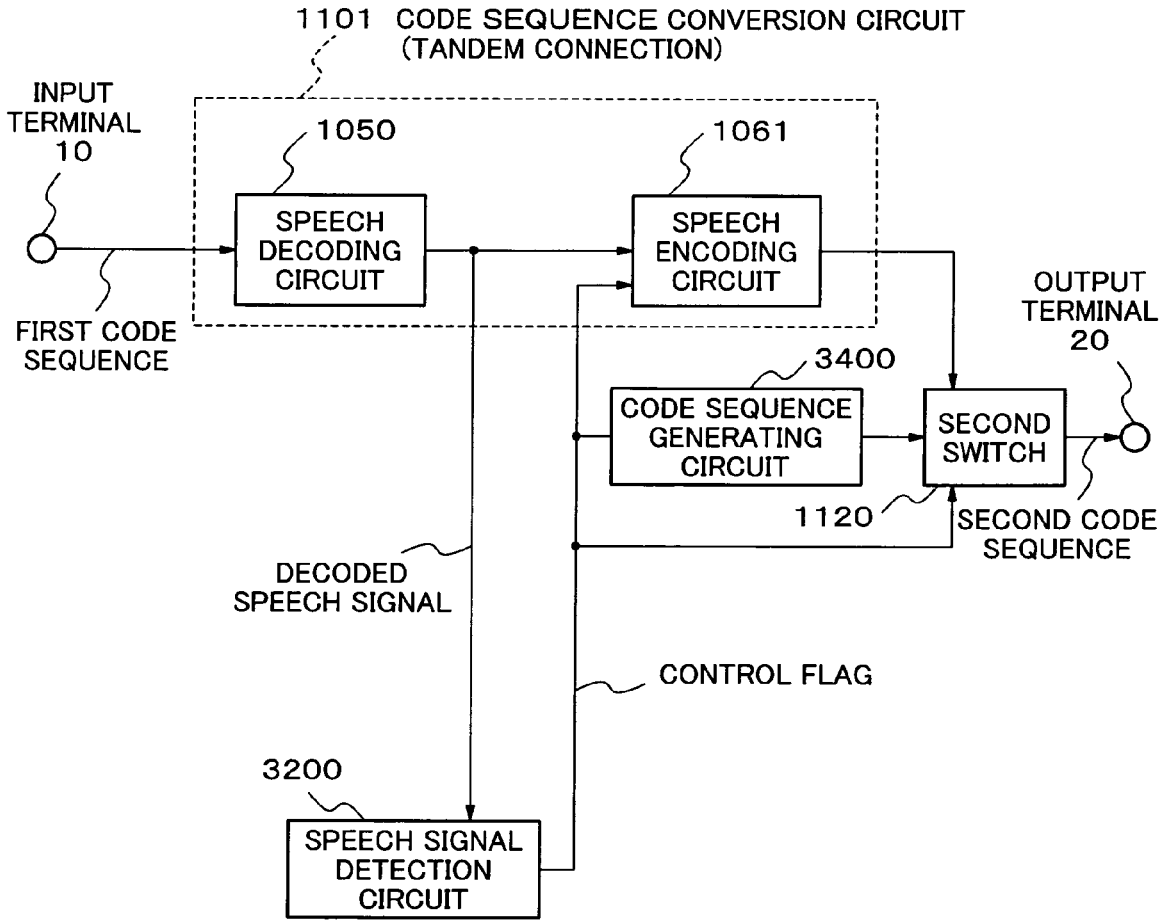
FIG. 5 is a block diagram showing the third embodiment of code conversion apparatus of the present invention.

FIG. 5 is a diagram showing the structure of Embodiment 3 of the code conversion apparatus according to the present invention. In FIG. 5, identical or equivalent elements appearing in FIG. 2 are denoted with the same reference numerals. In FIG. 5, the input terminal 10, the output terminal 20, the speech decoding circuit 1050 and the second switch 1120 are basically the same elements as those shown in FIGS. 1 and 2, except that interconnection between these elements partly differs. The description of Embodiment 3 below omits explanation of the above mentioned identical or equivalent elements, and explains differences from the structure shown in FIG. 2, i.e., a speech signal detection circuit 3200, a code sequence generating circuit 3400 and a speech encoding circuit 1061.

In FIG. 5, the speech decoding circuit 1050 supplies a decoded speech signal to the speech signal detection circuit 3200. The speech detection circuit 3200 outputs a control flag "0," when this decoded speech signal corresponds to a speech part. The speech detection circuit 3200 outputs a control flag "1," when the decoded speech signal corresponds to a non-speech part. This control flag is supplied to the speech encoding circuit 1061, the code sequence generating circuit 3400 and the second switch 1120.

Here, the speech signal detection circuit 3200 calculates this control flag by making use of such feature quantity characterizing the speech signal as pitch periodicity, spectrum slope, speech power, etc. that are computable from the decoded speech signal. Namely, the speech signal detection circuit sets a corresponding value to the control flag, discriminating whether these feature quantities correspond to a speech part or to a non-speech part. This control flag may classify the non-speech part into a noise part and a silence part, as is found in the output of the discrimination circuit 1300 in Embodiment 1.

For example, in the case of the feature quantity of speech power, the simplest way is to correspond a part having a relatively large power to the speech part and a part having a relatively small power to the non-speech part. Thus, the speech signal detection circuit 3200 sets "0" to the control flag when the power is large and "1" when power is small.

The details of the method of classifying the speech signal into speech and non-speech part are described in

[7] 3GPP TS 26.094, "AMR Speech Codec; Voice Activity Detector (VAD)."

The non-speech part is not restricted to noise or silence. For instance, tone signals may also be considered as non-speech part. In this case, the speech signal detection circuit 3200 provides an additional function of tone signal detection circuit. And this speech signal detection circuit sets, e.g. "3" to the control flag when the decoded speech signal corresponds to tone signals.

The details of the method of detecting tone signals are described in EP-A-1395065, "Tone detector and method therefore." (Reference [8])

In FIG. 5, the code sequence conversion circuit 1101 consists of the speech decoding circuit 1050 and the speech encoding circuit 1061.

The control flag is supplied to the speech encoding circuit 1061 from the speech signal detection circuit 3200. When this control flag value is "0" (indicating speech part), the speech encoding circuit 1061 re-encodes with the second speech coding scheme the decoded speech signal being output from the speech decoding circuit 1050. Then, the speech encoding circuit 1061 supplies the code sequence obtained through this re-encoding to the second switch 1120 as the second code sequence. The speech encoding circuit 1061 has a similar structure to that of the speech encoding circuit 1060 in Embodiment 1, except that the processing of speech encoding is performed or not performed on the basis of the value of the control flag.

The code sequence generating circuit 3400 generates the second code sequence corresponding to silence, noise or tones, when the control flag being output from the speech signal detection circuit 3200 indicates other values than the value of the speech part. The second code sequence thus generated is supplied to the second switch 1120. Here, the code sequence generating circuit 3400 generates the second code sequence corresponding to silence or noise in the same manner as the code sequence generating circuit 1400 in FIGS. 2 and 4.

As the code sequence generating circuit 1400 of FIG. 2, the code sequence generating circuit 3400 may be modified to output a second code sequence corresponding to a predetermined substitute signal (for example, a substitute signal determined by an upper apparatus of this embodiment) when the control flag value is a value other than "0(speech)". For instance, the code sequence generating circuit may be modified to output, irrespective of the control flag value, the second code sequence corresponding to "silence" even when the control flag value indicates non-speech part ("silence", "noise", "tone" etc. Further, the code sequence generating circuit may be modified to output the second code sequence corresponding to "noise" with small amplitude even when the control flag value indicates non-speech part.

Embodiment 4

Figure 6:
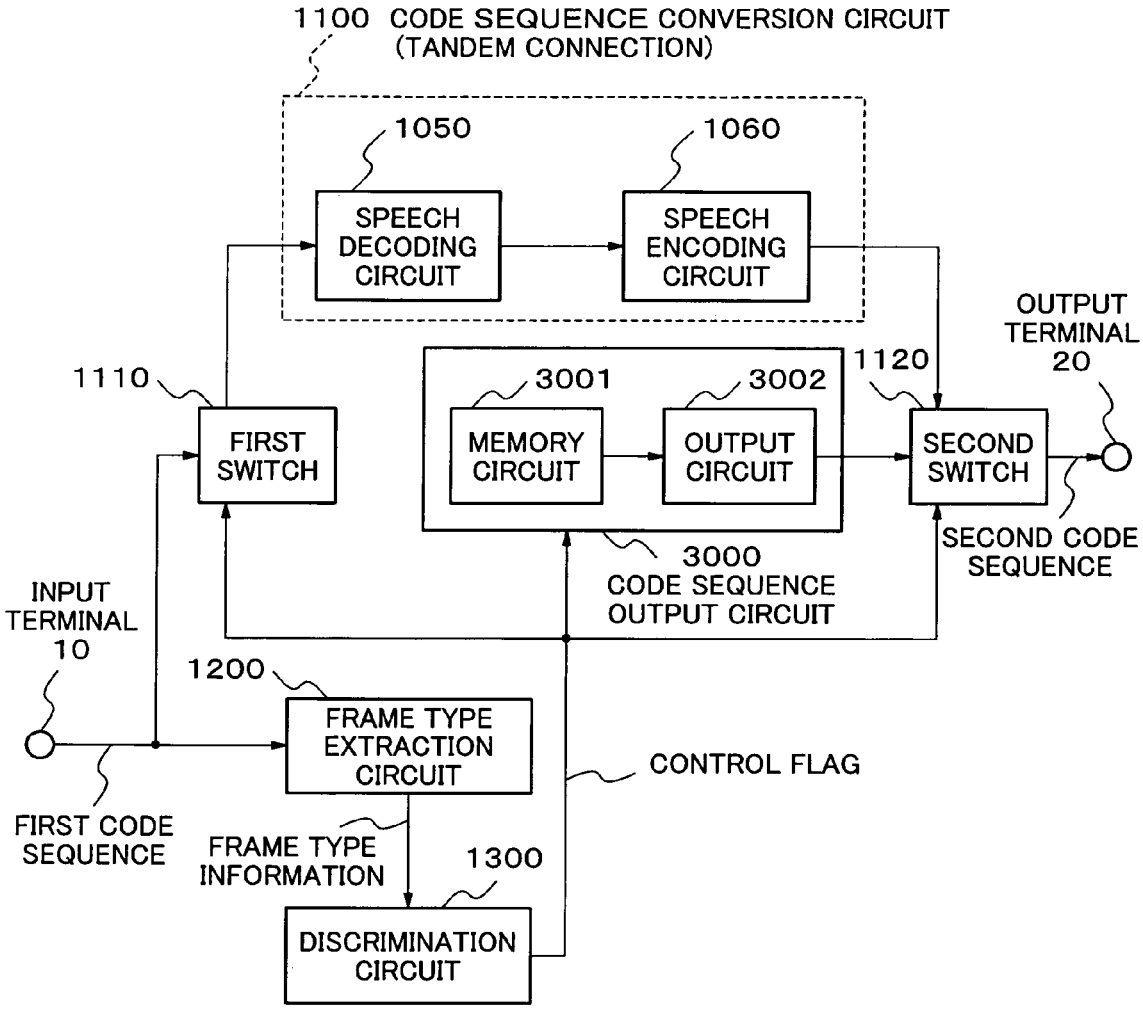
FIG. 6 is a block diagram showing the fourth embodiment of code conversion apparatus of the present invention.

FIG. 6 is a diagram showing the structure of Embodiment 4 of the code conversion apparatus according to the present invention. In FIG. 6, identical or equivalent elements appearing in FIG. 2 are denoted with the same reference numerals.

In the present Embodiment, the code sequence generating circuit 1400 in Embodiment 1 is replaced by a code sequence output circuit 3000. Such replacement may be applied to Embodiments 2 and 3.

Hereafter, the code sequence output circuit will be explained.

The code sequence output circuit 3000 consists of a memory circuit 3001 and an output circuit 3002.

The memory circuit 3001 pre-stores the second code sequence corresponding to non-speech part (silence, etc.) in relation to the values of the control flag.

For example, when the second speech coding scheme conforms, to 3GPP AMR Codec, the second code sequence consists of the header (the frame type is 15) only, because the size of payload for silence is 0 bit as described above.

When the second speech coding scheme conforms to ITU-T G.711, the payload consists of the 0×FF codes whose number is equal to the number of the samples corresponding to the frame length. For instance, if the frame length is 20 msec and the sampling frequency is 8000 Hz, the number of the samples corresponding to the frame length is calculated to be 160. The payload in this case is considered to be 1280 bit data having 160 0×FF codes. The details of ITU-T G.711 is given in the reference [5] mentioned earlier.

The above explanation is for generating the second code sequence for silence. Similar to Embodiment 1, a code sequence for noise may also be pre-stored in the memory circuit 3001.

The output circuit 3002 reads out the second code sequence stored in the memory circuit 3001 in accordance with the value of the control flag, and supplies this second code sequence to the second switch 1120.

In this embodiment, similar to Embodiment 1, the second switch 1120 outputs to the output terminal 20 the second code sequence being output from the speech encoding circuit 1060, when the control flag is "0" (indicating speech part). When the control flag is either "1" (indicating noise) or "2" (indicating silence), the second switch 1120 outputs the second code sequence being output from the code sequence output circuit 3000. Here, similar to Embodiment 1, the second switch 1120 may supply to the output terminal 20 the second code sequence being output from the speech encoding circuit 1060, when the control flag is either "0" or "1."

Embodiment 5

The code conversion apparatus in each of the above described Embodiments according to the present invention may be realized under the control of a computer such as a digital signal processor. In Embodiment 5, the code conversion apparatus under the control of a computer such as a digital signal processor will be explained.

Figure 7:
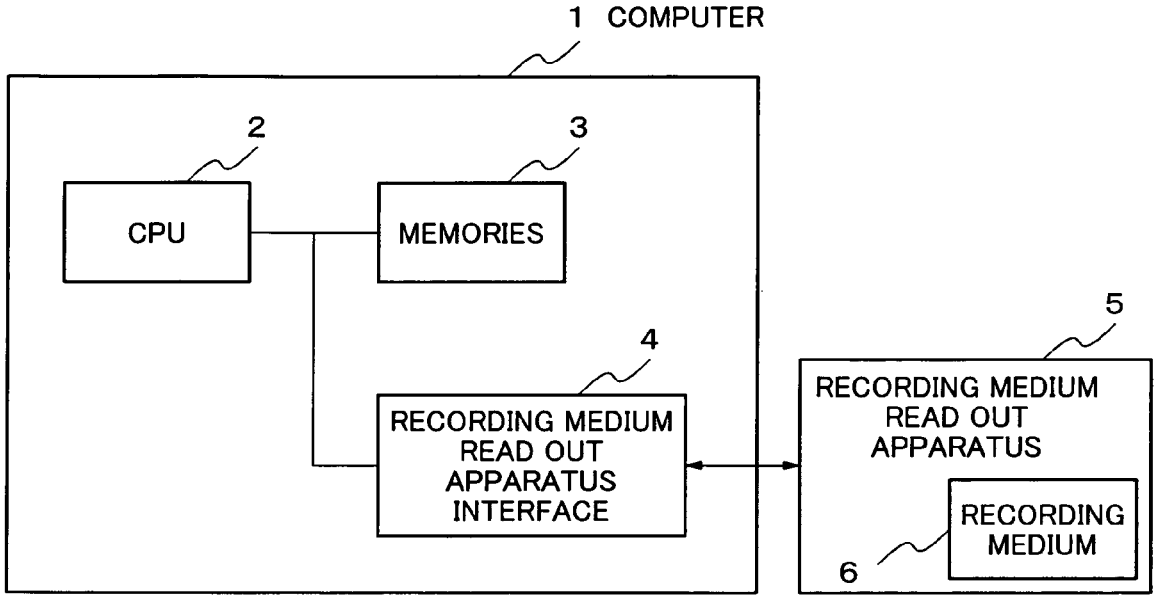
FIG. 7 is a block diagram showing the fifth embodiment of code conversion apparatus of the present invention.

FIG. 7 schematically depicts the structure of the apparatus where the code conversion processing in the above Embodiments 1 to 4 according to the present invention is realized by a computer. Embodiment 5 comprises a computer 1 and a recording medium read out apparatus 5. The computer 1 consists of a CPU (central processing unit) 2, a memory 3 and a recording medium read out apparatus interface 4. A recording medium 6 that stores a computer program is equipped within the recording medium read out apparatus 5. The CPU 2 first downloads the program stored in the recording medium 6 to the memory 3 via the recording medium read out apparatus interface 4, and executes operations similar to those in the above Embodiments 1 to 4.

The program for executing the following processing is stored in the recording medium 6.

(A) Processing of discriminating whether the first code sequence corresponds to a speech part or to a non-speech part by using the information contained in the first code sequence, and outputting a control flag indicating the discrimination result;

(B) Processing of converting the first code sequence into the second code sequence, when this control flag indicates a speech part; and (C) Processing of generating the second code sequence for non-speech corresponding to the flag, when this control flag indicates non-speech.

The processing (A) can be realized using the following processing (A1) and (A2).

(A1) Processing of decoding a speech signal from the first code sequence with the first decoding method; and (A2) Processing of discriminating whether the first code sequence corresponds to speech or non-speech using the decoded speech signal, and outputting a control flag indicating the discrimination result.

In FIG. 7, said program is read out from the recording medium 6 via the recording medium read out apparatus 5 and the recording medium read out apparatus interface 4 into the memory 3 for execution. The above program may be stored in non-volatile memories, such as a mask ROM, a flash memory, and so on. The recording medium includes, in addition to the non-volatile memories, a CD-ROM, an FD, a Digital Versatile Disk (DVD), a magnetic tape (MT), a portable HDD, etc. Furthermore, the recoding medium also includes a wired or wireless communication medium to carry a program, when a computer receives the program from server apparatus over a communication medium.

Further, the processing (C) may be realized by the following processing (C1).

(C1) Processing of outputting the second code sequence corresponding to the control flag, by selecting said second code sequence from the pre-stored second code sequences for non-speech. In this case, it is preferable to pre-store the second code sequences for non-speech in the recording medium 6 as part of the program.

While this invention has been described in connection with certain exemplary embodiments, it is to be understood that the subject matter encompassed by way of this invention is not be limited to those specific embodiments. On the contrary, it is intended for the subject matter of the invention to include all alternatives, modifications and equivalents as can be included with the sprit and scope of the following claims. Further, the inventor's intent is to retain all equivalents even if the claims are amended during prosecution.

What is claimed is:

1. A code conversion method for converting a first code sequence conforming to a first speech coding scheme into a second code sequence conforming to a second speech coding scheme, said method comprising the steps of:

(A) inputting said first code sequence, and discriminating whether said first code sequence corresponds to a speech part or to a non-speech part and generating a discrimination result;

(B) inputting said first code sequence, converting said first code sequence into said second code sequence and outputting said second code sequence, when the discrimination result indicates the speech part;

(C) encoding pre-determined one or more sound signals corresponding to non-speech including silence, noise and tones into codes by said second speech coding scheme, and pre-storing the codes encoded by said second speech coding scheme; and (D) stopping to input said first code sequence, generating said second code sequence by reading said pre-stored codes corresponding to a value based on the discrimination result, and outputting the generated second code sequence, when the discrimination result indicates the non-speech part.

2. The method as claimed in claim 1, wherein said step (A) generates said discrimination result based on information contained in said first code sequence.

3. The method as claimed in claim 2, wherein said step (A) generates said discrimination result, on the basis of frame type information contained in a frame within said first code sequence.

4. The method as claimed in claim 2, wherein said step (A) generates said discrimination result, on the basis of a frame size contained in a frame within said first code sequence.

5. The method as claimed in claim 4, wherein said frame size is represented by a size of payload in this frame.

6. The method as claimed in claim 1, wherein said step (A) includes the steps of:

(A1) generating a decoded speech signal from said first code sequence with a first decoding method; and (A2) discriminating whether the first code sequence corresponds to the speech part or to the non-speech part, on the basis of said decoded speech signal and generating said discrimination result.

7. The method as claimed in claim 1, wherein said step (B) includes:

(B1) generating a decoded speech signal from said first code sequence with a first decoding method, when the discrimination result indicates the speech part; and (B2) re-encoding said decoded speech signal with a second encoding method and generating said second code sequence.

8. The method as claimed in claim 1, wherein said first speech coding scheme and said second speech coding scheme are identical.

9. The method as claimed in claim 8, wherein said step (B) outputs said first code sequence as said second code sequence when the discrimination result indicates said speech part.

10. The method as claimed in claim 1, wherein said step (C) outputs a second code sequence corresponding to a predetermined signal or an assigned signal from the outside, when said discrimination result indicates said non-speech part.

11. Code conversion apparatus including at least one processor, and configured to convert a first code sequence conforming to a first speech coding scheme into a second code sequence conforming to a second speech coding scheme, said apparatus comprising:

a discrimination unit configured to, via said at least one processor, input said first code sequence, and to discriminate whether said first code sequence corresponds to a speech part or to a non-speech part and generates a discrimination result;

a speech part conversion unit configured to, via said at least one processor, input said first code sequence, and to convert said first code sequence into said second code sequence and to output said second code sequence, when the discrimination result indicates the speech part;

a switch unit configured to, via said at least one processor, stop said first code sequence when the discrimination result indicates the non-speech part: and a non-speech part generating unit configured to, via said at least one processor, encode pre-determined one or more sound signals corresponding to non-speech including silence, noise and tones into codes by said second speech coding scheme, to pre-store the codes encoded by said second speech coding scheme, and to generate said second code sequence by reading said pre-stored codes corresponding to a value based on said discrimination result, and to output the generated second code sequence, when the discrimination result indicates the non-speech part.

12. The apparatus as claimed in claim 11, wherein said discrimination unit generates said discrimination result based on information contained in said first code sequence.

13. The apparatus as claimed in claim 12, wherein said discrimination unit generates said discrimination result, on the basis of frame type information contained in a frame within said first code sequence.

14. The apparatus as claimed in claim 12, wherein said discrimination unit generates said discrimination result, on the basis of a frame size contained in a frame within said first code sequence.

15. The apparatus as claimed in claim 14, wherein said frame size is represented by a size of payload in the frame.

16. The apparatus as claimed in claim 11, wherein said discrimination unit includes:

a decoder configured to generate a decoded speech signal from said first code sequence with a first decoding method; and a speech detection circuit configured to discriminate whether the first code sequence corresponds to the speech part or to the non-speech part on the basis of said decoded speech signal and to output said discrimination result.

17. The apparatus as claimed in claim 11, wherein said speech part conversion unit includes:

a decoder configured to generate a decoded speech signal from said first code sequence with a first decoding method, when the discrimination result indicates the speech part; and a re-encoder configured to re-encode said decoded speech signal with a second encoding method and to generate said second code sequence.

18. The apparatus as claimed in claim 11, wherein said first speech coding scheme and said second speech coding scheme are identical.

19. The apparatus as claimed in claim 18, wherein said speech part conversion unit outputs said first code sequence as said second code sequence when the discrimination result indicates said speech part.

20. The apparatus as claimed in claim 11, wherein said non-speech part generating unit outputs said second code sequence corresponding to a predetermined signal or an assigned signal from the outside, when said discrimination result indicates said non-speech part.

* * * * *

UNITED STATES PATENT AND TRADEMARK OFFICE

CERTIFICATE OF CORRECTION

PATENT NO. : 8,374,852 B2
APPLICATION NO. : 11/376436
DATED : February 12, 2013
INVENTOR(S) : Atsushi Murashima It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1510 days.

Signed and Sealed this
Twenty-eighth Day of October, 2014

Michelle K. Lee

Michelle K. Lee
*Deputy Director of the United States Patent and Trademark Office*